US006528129B1

(12) United States Patent
Kondo

(10) Patent No.: US 6,528,129 B1
(45) Date of Patent: Mar. 4, 2003

(54) SURFACE TREATMENT METHOD, PRODUCTION METHOD FOR INK JET RECORDING MEDIUM, AND INK JET RECORDING MEDIUM

(75) Inventor: Yoshikazu Kondo, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/504,687

(22) Filed: Feb. 15, 2000

(30) Foreign Application Priority Data

Feb. 15, 1999 (JP) ..... 11-036216

(51) Int. Cl.[7] ..... H05H 1/46; B05D 3/06
(52) U.S. Cl. ..... 427/536; 427/539; 427/535
(58) Field of Search ..... 427/535, 536, 427/540, 539, 538

(56) References Cited

U.S. PATENT DOCUMENTS 4,518,681 A * 5/1985 Johnson et al.
4,861,644 A 8/1989 Young et al.
5,780,118 A * 7/1998 Tracy et al. ..... 427/536
5,792,517 A * 8/1998 Takeuchi ..... 427/540
5,993,917 A * 11/1999 Pan et al. ..... 427/536
6,048,575 A * 4/2000 Altavilla ..... 427/536

FOREIGN PATENT DOCUMENTS

| | | |
|---|---|---|
| JP | 248626 | 10/1990 |
| JP | 3143930 | 6/1991 |
| JP | 672308 | 9/1994 |
| JP | 748480 | 5/1995 |
| JP | 193783 | 7/1998 |

* cited by examiner

*Primary Examiner*—Marianne Padgett
(74) *Attorney, Agent, or Firm*—Bierman, Muserlian and Lucas

(57) ABSTRACT

By carrying out a plasma discharge treatment for a support in which an image receiving layer comprising a void structure is formed, the void structure of the surface layer is subjected to hydrophilic treatment to enhance the water absorption capability of a recording media in the thickness direction (in the depth direction) and to enhance image receiving capability. Further, by making a portion more adjacent to the surface hydrophobic, an image disorder after receiving ink droplets is minimized. Still further, by continually carrying out an image receiving layer forming plasma treatment, it is possible to more efficiently produce an ink jet recording medium.

21 Claims, 14 Drawing Sheets

FIG. 13 ( a )
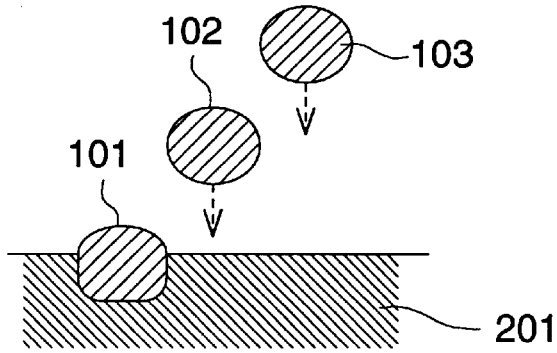
FIG. 13 ( b )
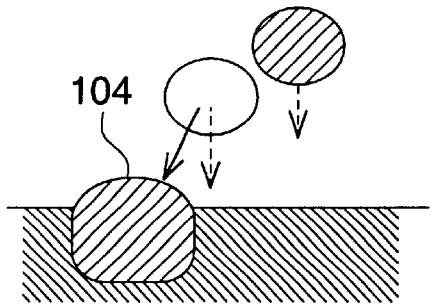
FIG. 13 ( c )
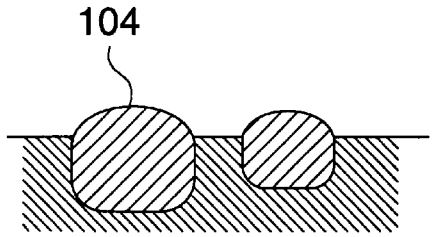

SURFACE TREATMENT METHOD, PRODUCTION METHOD FOR INK JET RECORDING MEDIUM, AND INK JET RECORDING MEDIUM

FIELD OF THE INVENTION

The present invention relates to a recording substrate having a void structure and production technique of the same. More specifically it relates to a recording medium advantageously effective to form a high quality image employing an ink jet recording system, and a production technique of the same. In more detail, the present invention relates to a technique to enhance ink image receptivity of substrate having support such as paper, plastic film, and the like by applying a discharge plasma treatment under atmospheric pressure or near atmospheric pressure to said supports.

BACKGROUND OF THE INVENTION

Ink jet systems, in a broad sense, include, for example, a bubble jet method, a piezo electrode method, and the like. Printers utilizing such systems are low in cost as well as resulting in less operating cost, compared to laser printers utilizing an electrostatic recording system. Thus, a number of ink jet printers for consumer use are being marketed and development for such printers is increasingly progressing.

As is commonly known, an ink jet system utilizes a technique in which ink is ejected from a fine opening followed by allowing the resulting ink droplets to contact a recording medium to form an image. Further, in the present invention, in describing the behavior of ink droplets which reach an image receiving surface of a recording medium and form an image, "collision", "arrival", and "shot" are employed to describe the same behavior. Furthermore, during ink jet printing, when image data, other than character data, are specifically printed, a recording medium is required to quickly and efficiently absorb ink droplets so that ink droplets ejected from an ink droplet ejecting unit (occasionally referred to as a printer head) are shot on the right spots and results in no blotting in the surface direction on the image receiving surface.

As recording media for such an ink jet system, plain paper is generally employed. However, with the development of better ink, ink jet printing has been applied to printing of cloth and the like. Further, along with the achievement of high quality due to finer ink droplets, multicolor, and higher quality obtained by more precise position control of the printing head, ink jet systems have recently, been applied to small volume printing with many types, small volume document printing and the like.

Currently, ink jet printers on the market are available which are capable of carrying out high resolution printing such as at least 1,200 dpi, and such type of printers not only carry out detailed printing but also can be provided with a high speed printing function.

Namely, enhancement of image quality as well as an increase in printing speed has been demanded for ink jet printers. Accordingly, research and development have been carried out not only for printers but also for the software to drive said printers, the ink, and the recording media. For example, now, in January 1999, there is a printer for consumer use, which utilizes a minimum droplet having a volume of only 6 pico liters (six trillionth liter).

At the same time, in order to allow the recording medium itself to contribute to improved image quality, exclusive printing paper has been proposed and demand for it has increased.

As described above, in the ink jet system, a method is utilized in which ink is ejected and onto a recording medium. As a result, when the recording medium is readily blotted with ink, image sharpness is degraded. On the contrary, when the recording medium exhibits low affinity with ink or repels ink, it is impossible to form images.

Special recording media which have been proposed or marketed are those in which the ink image receptivity is improved by forming a functional layer comprised of organic materials such as gelatin, PVA, and the like, or inorganic materials (silica, and the like) as the main component which is applied onto the surface of a substrate such as paper, plastic film (PET, PE, PP, PEN, and the like).

Problems to be Solved by the Invention

However, it is very difficult to control the physical surface properties such as "wettability" of the interior of voids only by coating methods. Further, quality and performance of inks are different depending on manufacturers, their products and the types of the ink itself. As a result, when compatibility is taken into account, it is difficult to determine a formula of a coating layer which works well with all types of inks. Further, it is not easy to vary the formula to suitably control the ink image receptivity.

Further, there are problems with adhesion and transfer after printing. These are due to the phenomena in which printing ink works just like an adhesive. Specifically, when printed sheets are piled up in close contact, the image receiving surface adheres with another surface. When these are forcibly peeled apart, the printed image is transferred or at the extreme case, the sheet is torn.

Further, due to the increase in printing speed, the ink ejection pitch (the time interval) has become shorter and problems with the generation of "displacement" have occurred. When an ink droplet is shot onto an image receiving layer and its soaking rate from the surface to the interior is small, as illustrated in FIGS. 13(*a*), 13(*b*) and 13(*c*) an ink droplet 102 is attracted to the previously shot ink droplet 101 which has not yet soaked into the paper surface 201, and the position of the subsequently ejected ink droplet is displaced from the intended position 104. As a result, in the position at which an ink droplet should be present, no ink droplet is placed (no ink droplet is ejected onto the target position), and thus the color reproduction is markedly deteriorated.

Further, enhancement in the image receptivity has resulted in adverse effects. The first adverse effect is a problem with "staining". For example, when an image receiving layer is touched with fingers, dirt as well as finger prints is attached, or the image receiving layer is subjected to swelling due to moisture absorption and the resulting image is deformed, and the like. The second adverse effect is an increase in "longitudinal blotting". This problem occurs in such a manner that an ink droplet ejected onto the image receiving surface spreads along the surface direction and is mixed with ink droplets ejected onto adjacent positions to cause undesired color mixture.

As described above, the improvement in image receptivity is accompanied with actual problems. At present, however, effective means to solve such problems have not yet been discovered, and all firms are developing recording media employing a trial and error method. For example, in the case of a technique described in Japanese Patent Publication Open to Public Inspection No. 10-193783, a receiving layer with a compact structure is formed and a technique to allow the resulting surface to be hydrophilic is proposed.

However, when only the surface is allowed to be hydrophilic, ink droplets are increasingly spread along the surface direction to degrade the quality, contrary to expectations.

Accordingly, the inventors of the present invention have investigated the problem and have revealed that an important factor is that as an ink droplet is ejected onto an image receiving surface, it is readily soaked in, in other words, the important factor is water absorbing capability (in both aspects of volume and rate) in depth of the recording medium. Specifically, it has been found that interference between ink droplets (occasionally referred to as dots) which are ejected to adjacent positions is minimized by increasing the water absorbing efficiency as well as the water absorbing rate through allowing the interior of the void structure to be hydrophilic and thus the recording function of the ink jet method can be enhanced.

Further, it has been found that contrary to making a surface hydrophilic, allowing the uppermost surface to be water-repellent is an effective measure to minimize staining on the paper surface and the like.

Further, it has been found that an ink jet recording medium, in which the surface layer is to be hydrophilic and only its surface is to be water-repellent, exhibits high image receptive capability.

However, regarding the method to enhance the image receptive performance by varying the physical properties of a coating layer, as described above, no means has been found which is capable of readily varying types in response to characteristics of ink economically and effectively. Further, regarding the appearance of "staining" as well as the increase in "longitudinal blotting" accompanied with the enhancement in image receptive performance, no solution has been proposed which allows for both to coexist, because the problems are counter to the improvement in the image receptive performance.

Regarding the surface modification of a support, various techniques have been proposed. For example, regarding coating, various techniques have been proposed for improvement in adhesion (film adhesion). Such techniques include a corona discharge treatment, a vacuum glow discharge treatment, a flame treatment, and in addition, an atmospheric pressure plasma surface treatment recently proposed, and the like. In particular, the details of the atmospheric pressure plasma treatment are described in Japanese Patent Publication Open to Public Inspection Nos. 3-143930 and 4-74525, and Japanese Patent Publication Nos. 2-48626, 6-72308, and 7-48480, and the like. The feature is that under atmospheric pressure or pressure near it, plasma is generated by discharging into an atmosphere composed of argon gas or helium gas as the main component, and a support is subjected to surface treatment employing the resulting plasma.

The inventors of the present patent application have confirmed that such surface modifying techniques markedly improve the image receptive performance of the ink image receptive layer, and further solve problems with "staining" as well as the generation of "displacement", and thus the present invention has been achieved.

However, the plasma treatment has problems in which plasma generating conditions are difficult and control of the process is difficult.

Further, during the plasma treatment, the moisture in the reaction gas contributes to the substitution of a functional group. When the moisture content is increased to enhance the substitution efficiency, problems have occurred in which the output of the power source decreases and discharge is not stable.

SUMMARY OF THE INVENTION

Means to solve these problems have been investigated. As a result, highly effective conditions for the improvement of an ink receptive layer regarding the control of plasma were discovered.

Namely, a first object of the present invention is to enhance the image receptive performance of a recording media for the ink jet method, employing a surface modifying method.

A second object of the present invention is to minimize or solve problems with "staining" of a recording medium for the ink jet method, employing a surface modifying method.

A third object of the present invention is to minimize or eliminate the generation of "longitudinal blotting" of a recoding medium for an ink jet method, employing a surface modifying method.

A fourth object of the present invention is to optimize plasma generating conditions employed for a surface modifying method.

The present invention and its embodiments are described.

1. A method of surface treatment of a substrate having a void layer having void structure provided on a support comprising step of subjecting plasma treatment to the substrate.
2. The surface treatment method, wherein a functional group is provided with the substrate employing said plasma treatment.
3. The surface treatment method wherein void is roughened employing said plasma treatment.
4. The surface treatment method wherein the void layer contains particles, and the particles are roughened employing said plasma treatment.
5. The surface treatment method wherein said plasma treatment is carried out under an atmosphere comprised of an inert gas as the main component.
6. The surface treatment method wherein the void layer is provided at a portion furthest from the support.
7. The surface treatment method wherein the void layer is provided by coating.
8. The surface treatment method wherein at least one of the interior of the void layer and the surface layer of the void layer is subjected to a hydrophilic treatment employing said plasma treatment.
9. The surface treatment method wherein the surface layer of the void layer is subjected to a water repelling treatment employing said plasma treatment.
10. The surface treatment method wherein said plasma treatment is carried out employing corona discharge.
11. The surface treatment method wherein said plasma treatment is carried out under atmospheric pressure or similar pressure employing glow discharge.
12. The surface treatment method wherein a water repellent treatment is carried out after carrying out a hydrophilic treatment employing said plasma treatment.
13. The surface treatment method comprising a step of placing said substrate in a gas atmosphere and introducing said gas into said void structure, before said plasma treatment is carried out.
14. The surface treatment method wherein the substrate is ink-jet paper.
15. The surface treatment method wherein said plasma treatment is carried out by employing plasma generated in a pulse electric field.
16. The surface treatment method wherein step of subjecting plasma treatment to the substrate comprises steps of making gas plasma state, and introducing gas in the plasma state into said void structure.

17. The surface treatment method comprising steps of introducing gas in the plasma state into said void structure, before said plasma treatment is carried out wherein the plasma treatment is carried out by discharging on the substrate into whose void structure gas has been introduced.
18. A production method of an ink jet paper comprising a void layer having void structure provided on a support, wherein the method comprises a step of subjecting plasma treatment to the void layer.
19. The production method comprising step of forming a void layer on the support before said plasma treatment is carried out.
20. The production method of a base material, which comprises a void layer having a void structure, consists of the following steps: a step in which the void layer, having a void structure, is provided onto a support, and a step in which the void layer is subjected to plasma treatment.

BRIEF DESCRIPTION OF THE DRAWINGS

FIGS. 13(*a*), (*b*) and (*c*) are view showing a shot state in which lateral blotting occurs.

Figure 1:
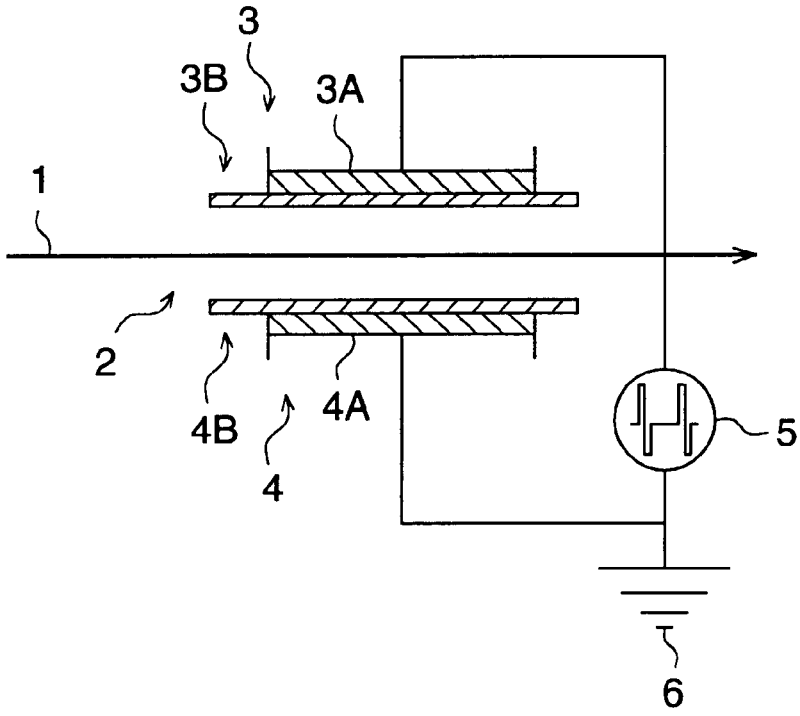
FIG. 1 is a schematic constitutional view showing one embodiment of the first method and apparatus of the present invention.

The other embodiments are described.

(1) A surface treatment method in which a plasma treatment is applied to a substrate comprising thereon a surface layer having a void structure.
(2) The surface treatment method described in (1), in which a functional group is provided with said substrate employing said plasma treatment.
(3) The surface treatment method described in (1), in which said void is roughened employing said plasma treatment.
(4) The surface treatment method described in (1), in which said plasma treatment is carried out under an atmosphere comprised of an inert gas as the main component.
(5) The surface treatment method described in (1), in which said surface having a void structure is a surface of said substrate.
(6) The surface treatment method described in (1), in which said surface layer having a void structure is a layer coated onto said substrate.
(7) The surface treatment method described in (1), in which the interior and/or the surface of said surface layer having a void structure be allowed to be hydrophilic employing said plasma treatment.
(8) The surface treatment method described in (1), in which surface water-repellency of said surface layer having a void structure is enhanced employing said plasma treatment.
(9) The surface treatment method described in (1), in which said plasma treatment is carried out employing corona discharge.
(10) The surface treatment method described in (7), in which said plasma treatment is carried out employing a flame.
(11) The surface treatment method described in (7) or (8), in which said plasma treatment is carried out under atmospheric pressure or similar pressure employing glow discharge.
(12) The treatment method described in (1), in which said plasma treatment is carried out at an absolute humidity of at least 0.0005 kg-steam/kg-dry gas.
(13) The surface treatment method described in (1), in which after carrying out a hydrophilic treatment employing said plasma treatment, a hydrophobic treatment is carried out.
(14) The surface treatment method described in (1), in which in order to carry out said plasma treatment, said substrate is placed in a gas atmosphere and after introducing said gas into said void structure, said plasma treatment is carried out.
(15) The surface treatment method described in (1), in which said substrate is an ink jet recording medium.
(16) An ink jet recording medium characterized in being produced employing the surface treatment methods described in (1) through (14).
(17) A surface treatment method for a substrate in which a substrate thereon comprising a surface layer having a void structure is subjected to said plasma treatment employing plasma generated in a pulse electric field.
(18) The surface treatment method described in (17), in which the absolute humidity in the ambience, in which said plasma is generated, is at least 0.005 kg-steam-/kg-dry gas.
(19) The surface treatment method described in (17), in which a functional group in the said substrate is formed employing said plasma treatment.
(20) The surface treatment method described in (17), in which the surface of said surface layer having a void structure is roughened employing said plasma treatment.
(21) The surface treatment method described in (17), in which said surface layer having a void structure forms a surface of said substrate.
(22) The surface treatment method described in (17), in which said surface layer having a void structure is a coated layer provided on said support.

(23) The surface treatment method described in (17), in which at least the surface of said surface layer having a void structure is subjected to a hydrophilic treatment employing said surface modification.

(24) The surface treatment method described in (17), in which the interior and/or the surface of said surface layer having a void structure be subjected to a water repelling treatment employing said surface modification.

(25) The surface treatment method described in (17), in which said plasma treatment is carried out employing glow discharge.

(26) The surface treatment method described in (17), in which said plasma treatment is carried out under atmospheric pressure or near such pressure.

(27) The surface treatment method described in (17), in which said plasma treatment is carried out under an atmosphere.

(28) The surface treatment method described in (17), in which said plasma treatment is carried out in atmosphere comprising a reaction gas in an amount of at least 30 volume percent.

(29) The surface treatment method described in (17), in which said plasma treatment is carried out at an absolute humidity of 0.005 kg-steam/kg-dry gas.

(30) The surface treatment method described in (17), in which after carrying out a hydrophilic treatment employing said plasma treatment, a hydrophobic treatment is carried out.

(31) The surface treatment method described in (17), in which said substrate is an ink jet recording medium.

(32) An ink jet recording medium characterized in being produced by employing surface treatment methods described in (17) through (30).

(33) A production method of an ink jet recoding medium in which a support which is continually conveyed is successively subjected to pre-treatment, coating and drying to form a functional layer followed by post-treatment of said functional layer.

(34) The production method of an ink jet recording medium described in (33), in which said pre-treatment is a plasma treatment.

(35) The production method of an ink jet recording medium described in (33), in which said pre-treatment is a corona discharge treatment.

(36) The production method of an ink jet recording medium described in (33), in which said post-treatment is a plasma treatment.

(37) The production method of an ink jet recording medium described in (33), in which said plasma treatment is carried out employing a plasma generated in a pulse electric field.

(38) A surface treatment method of (33), in which the absolute humidity of the ambience in which said plasma is generated is at least 0.005 kg-steam/kg-dry gas.

DETAILED DESCRIPTION OF THE INVENTION

The embodiments of the present invention are described below.

Figure 15:
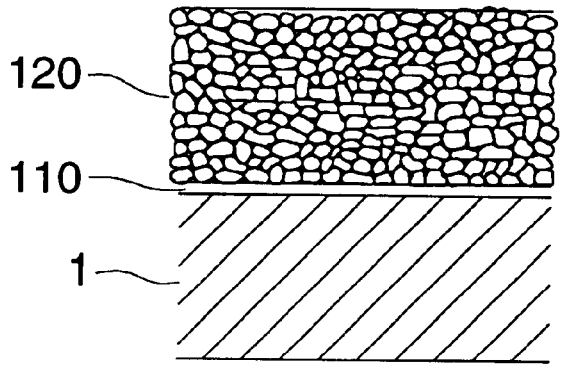
FIG. 15 is a sectional view of a substrate before the plasma treatment according to the invention.
Figure 15:
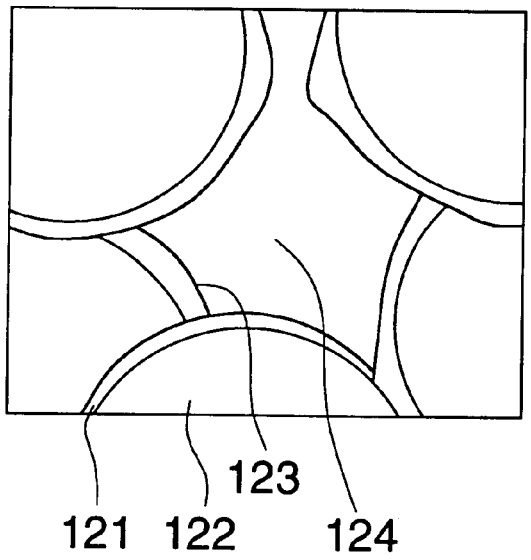

FIG. 15 is a sectional view of a substrate before the plasma treatment according to the invention. A subbing layer such as a gelatin layer is provided on a support, and an image receiving layer having void (functional layer) is provided thereon. The uppermost layer of the image receiving layer is referred to "surface layer" and surface of particles interior of void layer is referred to "surface".

Employed as the support for the substrate having a void structure employed in the present invention is a film selected from polyethylene terephthalate, polyethylene, and polypropylene, paper, and the like.

Specifically an ink jet recording medium is produced as follows. For example, a thin gelatin layer is applied onto the surface of a support providing a polyethylene layer which is applied onto both surfaces of pulp-based paper. The resulting surface is subjected to single- or multi-layer coating employing a water-based coating composition prepared by dispersing silica and PVA as the main components, and subsequent drying. Thus a recording medium having the image receiving layer (a functional layer) prepared as described above is produced. The resulting the image receiving layer is subjected to plasma treatment to improve image receiving performance. Regarding layer structure, a coating composition having the same composition may be multi-coated. In accordance with specific requirements, it is possible to select the coating composition, the layer thickness as well as the number of layers. It is preferable to provide the image receiving layer by means of coating, and other means may be applied.

Regarding coating for the formation of the image receiving layer, proposed are techniques which are conventionally applied to the production of photosensitive materials, and any of such techniques may be employed. For example, any of several preferred methods of the following may be selected; a fountain type, a wire bar type, a blade type, a slide hopper type, a curtain type, and the like. Specifically, when multilayer coating is carried out for a wider support at a relatively high speed, the techniques for the slide hopper type or the curtain type are preferably employed.

An image receiving layer is comprised of silica and PVA. Specifically a PVA layer is formed on silica particles, and many of these particles are coagulated while producing voids. When ink droplets reach the image receiving layer, the ink droplets soak into these voids to form an image.

When said image receiving layer is subjected to plasma treatment so as to provide hydrophilicity, many polar functional groups (an amino group, a carboxyl group, a hydroxyl group, a carbonyl group, and the like) are provided with the PVA layer on the surface of said silica. As a result, ink absorbing efficiency as well as ink absorbing rate is improved. Further, the surface of the PVA layer on silica particles in the interior of the void layer is finely roughened (giving an anchor effect) through etching to increase the surface area of the void formed between particles. As a result, the ink absorbing efficiency as well as the ink absorbing rate is also improved. Opposed to hydrophilicity, by carrying out a hydrophobic treatment on the uppermost surface (surface layer) of the image receiving layer, it is possible to minimize the spread of ink droplets in the surface direction (also referred to as lateral direction) and to prevent "lateral blotting" as shown in FIGS. 14(*a*), 14 (*b*) and 14 (*c*).

When an ink droplet is shot onto an image receiving layer and its soaking rate from the surface to the interior is small, as illustrated in FIGS. 13(*a*), 13(*b*) and 13(*c*) an ink droplet 102 is attracted to the previously shot ink droplet 101 which has not yet soaked into the paper surface 201, and the position of the subsequently ejected ink droplet is displaced from the intended position 104. As a result, in the position at which an ink droplet should be present, no ink droplet is placed (no ink droplet is ejected onto the target position), and thus the color reproduction is markedly deteriorated.

Figure 14:
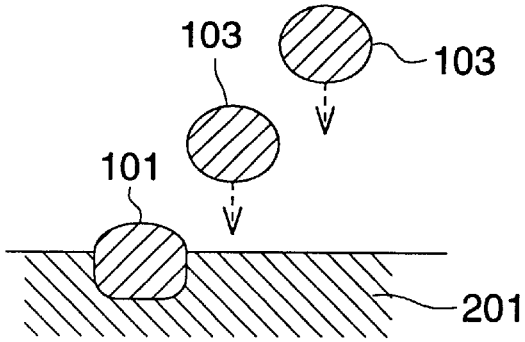
FIGS. 14(*a*), (*b*) and (*c*) are view showing a shot state in which no lateral blotting occurs.
Figure 14:
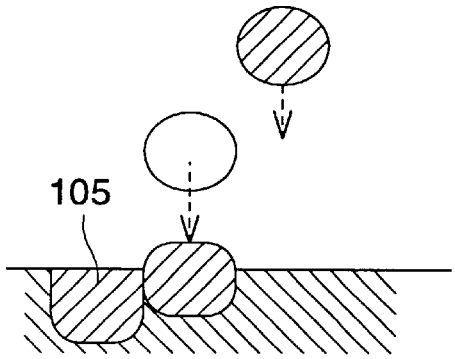
Figure 14:
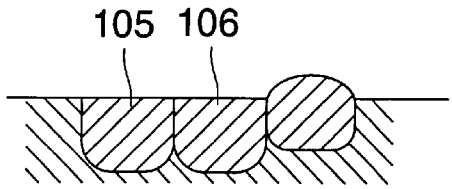

To the contrary, when the ink droplet is shot onto an image receiving layer and its soaking rate from the surface to the interior is sufficient, as illustrated in FIGS. 14(*a*), 14(*b*) and 14(*c*) an ink droplet 103 is received in the paper surface 201 at the intended position 106.

As described above, it is possible to control the provided properties and degree thereof (degree of contribution due to the plasma treatment) by suitably varying the electric field strength, the plasma treatment gas conditions (reaction gas concentration, the gas enclosing conditions, the atmospheric pressure, and the like), the discharge conditions, the humidity conditions described below, and the like. Namely, as desired, it is possible to optionally vary the degree of provided hydrophilicity as well as hydrophobicity. Specifically, it is possible to optionally control the depth and thickness in which said hydrophilicity or hydrophobicity is enhanced, and the degree of said improvement in hydrophilicity or hydrophobicity, and the like in the range of a thickness of Å to sub-$\mu$m. As a result, the ink jet recording media according to the present invention can correspond to a variety of market needs and is suitable for the conversion of product types as well as the production of many types at small volumes.

The hydrophilic treatment specifically will now be described. When the void in the interior of image receiving later as the target is subjected to treatment, is effective the sufficient inclusion of a reaction gas necessary for discharge in the void. Therefore, it is preferable to extend the gas purging (gas introduction) time. This may be carried out by employing a method in which the support is suspended in a gas chamber (called off-line purging) or a method in which the support passes through the gas purging process on-line. In methods other than said gas purging, it is preferable to employ small molecule gas as the reaction gas. When employing such gas of small molecules, said reaction gas is likely to quickly enter voids and specifically, it is preferred to employ He and the like. The reaction gas included in the void is not readily expelled and is consumed during the plasma treatment, enhancing the surface modifying effect of the void, i.e., surface modifying effect of particles.

The hydrophobic treatment, specifically, will now be described. By employing fluorine-containing compound gases as the treatment gas, fluorine-containing groups are formed on the surface of the substrate (surface layer) to decrease the surface energy, and a hydrophobic surface can be obtained. Listed as aforementioned fluorine-containing compounds may be fluorine-carbon compounds such as carbon tetrafluoride, carbon hexafluoride, propylene tetrafluoride, cyclobutane octafluoride, and the like, halogen-carbon compounds such as carbon monochloride trifluoride and the like, and fluorine-sulfur compounds such as sulfur hexafluoride and the like. From the viewpoint of safety, carbon tetrafluoride, carbon hexafluoride, propylene hexafluoride, and cyclobutane octafluoride are preferably employed, since they do not form toxic hydrogen fluoride.

Next, a treatment employing plasma generated by a pulsed electric field will now be described. In such plasma treatment, the plasma is generated mainly by forming an electric field in the reaction gas. By converting an electric field in the pulse electric one, plasma intensity becomes specially high and uniform. Thus a large modifying effect for a treated material is obtained.

Discharge plasma is generated by applying a pulse electric field to electrodes arranged in a treatment section. Cited as the pulse waveform is the example shown in FIG. 2. However, it is not limited to this example and a pulse waveform shown in FIG. 1(*a*) through 1(*d*) of Japanese Patent Publication Open to Public Inspection No. 10-130851 may also be employed. In FIG. 2, the ordinate represents the pulse voltage and the abscissa represents the time.

When the discharge plasma, generated by applying the pulse electric field to electrodes, is employed for the surface treatment, said plasma exhibits sufficient treatment function even in air.

The frequency of the pulse electric field is preferably in the range of 5 to 100 kHz.

The time in which one pulse electric field is applied is preferably between 1 and 1,000 $\mu$s. "The time in which one pulse electric filed is applied" as described herein means time in which the pulse having the pulse waveform shown in FIG. 2 is applied.

The voltage applied to a counter electrode is not limited. However, when the voltage is applied to said electrode, the resulting electric field strength is preferably in the range of 1 to 100 kV/cm.

Next, techniques will be described to vary the degree of plasma generation and the degree of said treatment by controlling the ambient humidity.

As described above, during the plasma treatment, moisture ($H_2O$) in the ambient air contributes as a reaction gas. When this ratio is high, a conventional power source has resulted in decrease in output or unstable discharge (non-uniform plasma treatment).

On the other hand, by generating plasma employing the pulse electric field, it becomes possible to carry out discharge even in the presence of abundant $H_2O$, and it is thus possible to overcome the problems described above.

Specifically, compared to $O_2$ and $CO_2$, $H_2O$ is markedly effective because less ozone is generated, which is a by-product during the generation of plasma, and in addition, the desired surface modifying effect is obtained.

Furthermore, the content ratio of ambient water is preferably at least 0.005 kg-steam/kg-dry gas in terms of absolute humidity, is more preferably at least 0.009 kg-steam/kg-dry gas, and is still more preferably at least 0.012 kg-steam/kg-dry gas.

The absolute humidity can be obtained by referring to the constant temperature humidity graph (called the wet line graph). Further "at least 0.005 kg-steam/kg-dry gas" as described herein implies that for example, (1) at a temperature of 20° C., the relative humidity is at least 35 percent, (2) at a temperature of 25° C., the relative humidity is at least 25 percent, and (3) at a temperature of 30° C., the relative humidity is at least 19 percent.

Next, techniques for carrying out a continuous treatment will be described.

On a substrate to which a surface modifying treatment is applied, its image receiving layer is formed by a coating technique. After carrying out a pre-treatment, by continuously carrying out coating and post-treatment, it is possible to efficiently obtain a surface treated ink jet recording medium employing a continuous production process.

Figure 12:
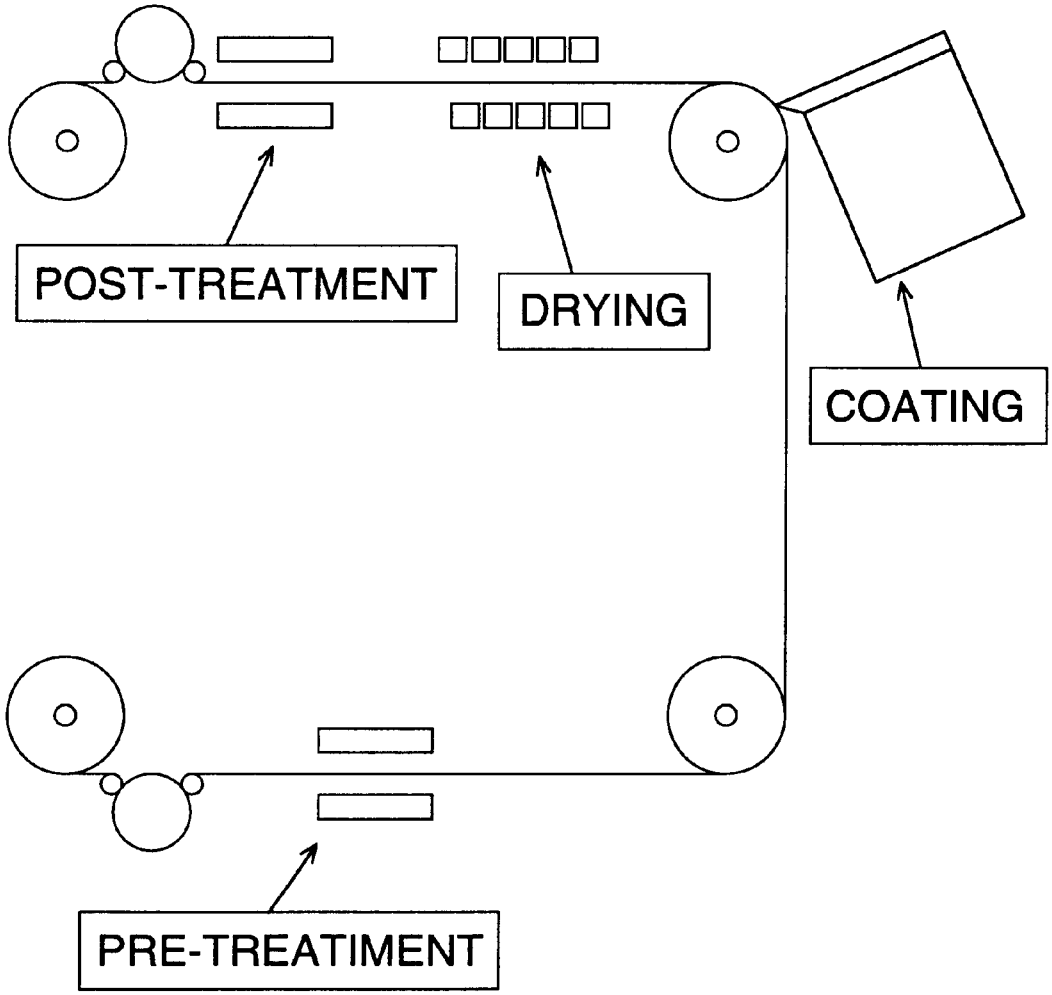
FIG. 12 is a flow diagram showing the continual treatment process of the present invention.

Specifically, as shown in FIG. 12, a continually conveyed support is subjected to pre-treatment while passing through a pre-treatment process.

Said pre-treatment is one to enhance the affinity of the coating composition with the support, and specifically, it is preferable to employ a plasma treatment, a corona discharge treatment, and the like. A gelatin layer or so may be formed by coating gelatin, etc.

After passing through said pre-treatment, the support is conveyed to a coating process. During the coating process, a previously prepared coating composition is applied to the support. Utilized as coating methods may be any of several suitable methods such as a curtain method, a slide hopper method, and the like.

During said coating process, it is possible to carry out high-speed coating as well as thin layer coating because the adhesion of the coating composition for image receiving layer onto the support (occasionally referred to as layer adhesion) is improved due to the surface modification of the support in the pre-treatment.

Subsequently, the resulting support is conveyed into a drying process. During this process, dryer conditions (the temperature of blown air, blown air volume, shape, size, position of the blowout hole and the like of the blown air outlet) are set so that the coating can be more quickly dried.

After passing through said drying process, the support, namely, the substrate, on which an ink receiving layer is formed, is conveyed into a post-treatment process. During said post-treatment process, the surface modifying treatment in the void (i.e., surface modifying treatment of particles forming void of the image receiving layer), as described above, is carried out to enhance ink receptivity. In said post-treatment, as described above, in order to generate plasma, the ambient atmosphere, humidity conditions, reaction gas, and the like may be suitably determined and applied.

Further, in said post-treatment process, a plurality of plasma treatment processes may be provided. For example, first, a hydrophilic treatment may be carried out to enhance the water absorbability of the image receiving layer, and subsequently, mainly the surface layer of the image receiving layer may be subjected to a hydrophobic treatment. Thus it is possible to take measures to minimize surface staining and image blotting of cross direction (face direction).

As described above, by employing continual treatment, it is possible to efficiently produce the desired ink jet recording media.

Further, though not shown in FIG. 12, it is possible to provide a setting process prior to the coating process and drying process. When, during the coating process, a water-based coating composition comprising binders is coated, and after coating, the coating is directly conveyed into the drying process, the coated layer suffers mottling due to the effects of drying air. Therefore, the coated layer is temporarily set employing cool air and then dried.

The specific processing apparatus is described below.

Figure 2:
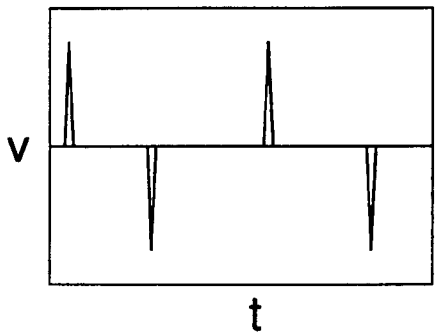
FIG. 2 is a view showing one waveform of a pulse.

FIG. 1 is a schematic constitutional view to describe a first method and apparatus.

In FIG. 1, reference numeral 1 is a continuous support which is continually conveyed, 2 is a treatment section which continually carries out plasma treatment under normal atmospheric pressure or similar pressure, and 3 and 4 are paired electrodes.

Treatment section 2 is exposed to ambient air so as to carry out a first method and does not constitute a treatment section. The gap formed between paired electrodes 3 and 4 constitutes a treatment section.

In the treatment section 2, it is acceptable that there is ambient air under normal atmospheric or similar pressure. However, it is possible to further provide a baffle plate or a nip roll in order to generate an air flow or regulate its flow, and to check control the air flow. In addition, it is possible to provide an exhaust duct to discharge and discard generated byproducts (for example, gases and the like).

When surface treatment is carried out in the treatment section 2, coatability as well as adhesion of the coated layer is improved and functional group forming properties are improved. Further, a surface is formed which has optical, electrical, mechanical functions and the like. From the viewpoint of the enhancement of coatability, coating is preferably carried out immediately after such surface treatment in order to minimize the degradation of the treated surface during its storage.

In the example shown in FIG. 1, paired electrodes 3 and 4 are comprised of metal electrodes 3A and 4A, and solid dielectrics 3B and 4B. Commonly, the solid dielectrics 3B and 4B are adhered to the metal electrodes 3A and 4A, which are comprised of electrically conductive materials such as silver, gold, copper, stainless steel, aluminum, and the like. However, the solid dielectrics 3B and 4B may be adhered with those employing plating, evaporation, spraying, and the like.

Preferably employed as solid dielectrics 3B and 4B are sintered type ceramics obtained by sintering high heat resistant ceramics having high air tightness. Materials of sintered type ceramics include, for example, alumina-based, zirconia-based, silicone nitride-based silicone, and silicone carbide-based ceramics. The thickness of the alumina ceramics is preferably about 1 mm. Further, its volume specific resistance is preferably at least $10^8$ Ω·cm.

When an alumina based sintered type ceramics is employed as the sintered type ceramics, the alumina based sintered type ceramics having a purity of at least 99.6 percent is preferably employed to enhance the durability of said electrodes. As a reference on the alumina based sintered type ceramics, Japanese Patent Publication Open to Public Inspection No. 11-191500 may be utilized.

The production method for electrodes, employing said sintered type ceramics, is as follows. A sintered type ceramics is prepared by sintering a high heat resistant ceramics, and metal electrodes are adhered to the resulting sintered type ceramics employing plating, vaporization, spraying, coating, and the like.

Further, low temperature glass lining described in Japanese Patent Application No. 10-300984 may also be applied to the solid dielectrics 3B and 4B.

Metal electrodes 2A and 4A may be entirely or partly covered with the solid dielectrics 3B and 4B.

The gap between the electrodes is preferably between 0.3 and 10 mm in terms of the distance between the surfaces of the facing solid dielectrics 3B and 4B, is more preferably between 1 and 10 mm, and is still more preferably 3 mm.

Further, in FIG. 1, plate electrodes such as paired electrodes 3 and 4 are employed. However, one or both electrodes may be cylindrical electrodes or roll-shaped electrodes, or gas flow type curved surface electrodes may be employed. Such electrodes will be detailed in the second method and its apparatus.

Of said paired electrodes 3 and 4, one electrode 3 is connected to high frequency power source 5 and the other electrode 4 is grounded through conductor 6, and the paired electrodes 3 and 4 are constituted so that a pulse electric field can be applied between them.

In the first method, it is preferable that prior to any surface treatment, the charge on the surface of a substrate (surface layer) is eliminated, and further, all dust is removed because the uniformity of the surface treatment is thereby further enhanced. Preferably employed as charge eliminating means are, in addition to the common blower method, and a contact method, a high density charge eliminating system (described in Japanese Patent Publication Open to Public Inspection No. 7-263173) in which a charge eliminating electrode for forming a plurality of positive and negative ions, a charge eliminating unit facing an ion attracting electrode so as to put a substrate between, and after following that, a positive and negative direct current type charge eliminating unit are arranged. At that time, the charge voltage of the support is preferably no more than ±500 V. Further, as a dust removing means after the charge eliminating process, a non-contact jet flow system reduced pressure type dust removing unit (described in Japanese Patent Publication Open to Public Inspection No. 7-60211, and the like) and the like are preferred. However, the present invention is not limited to these.

In this first method and its apparatus of the present invention, the pressure similar to atmospheric pressure is between 100 and 800 Torr, and is preferably in the range of 700 to 780 Torr.

In this method, discharge plasma is generated by applying a pulse electric field in the gap between the aforementioned facing electrodes, and an example of the pulse waveform is shown in FIG. 2. However, the present invention is not limited to this example, and any of the pulse waveforms shown in (a) through (d) of FIG. 1 may be employed. In FIG. 2, the ordinate designates the pulse voltage while the abscissa designates the time.

When discharge plasma generated by the application of such a pulse electric field is employed for a surface treatment, sufficient surface treatment properties are obtained even in ambient air.

The frequency of the pulse electric field is preferably in the range of 5 to 100 kHz.

Time for the application of one pulse electric field is preferably between 1 and 1,000 $\mu$s. The time for the application of one pulse electric field as described herein means time for the application of one of the pulse waveforms shown in FIG. 2.

The voltage applied to facing electrodes is not particularly limited. However, it is preferable that the voltage be controlled so that when applied to the electrodes, the electric field strength is in the range of 1 to 100 kV/cm.

The power source output which is applied to the facing electrodes is preferably between 3 and 40 kW/m$^2$, and is more preferably about 10 kW/m$^2$.

Further, the duration for applying said plasma treatment to a support may be adjusted by controlling the conveyance speed of said support in accordance with the length of the treatment section. However, the time is preferably between 0.3 and 60 seconds, and is more preferably about 3 seconds.

Next, a second method and apparatus will be described.

Figure 3:
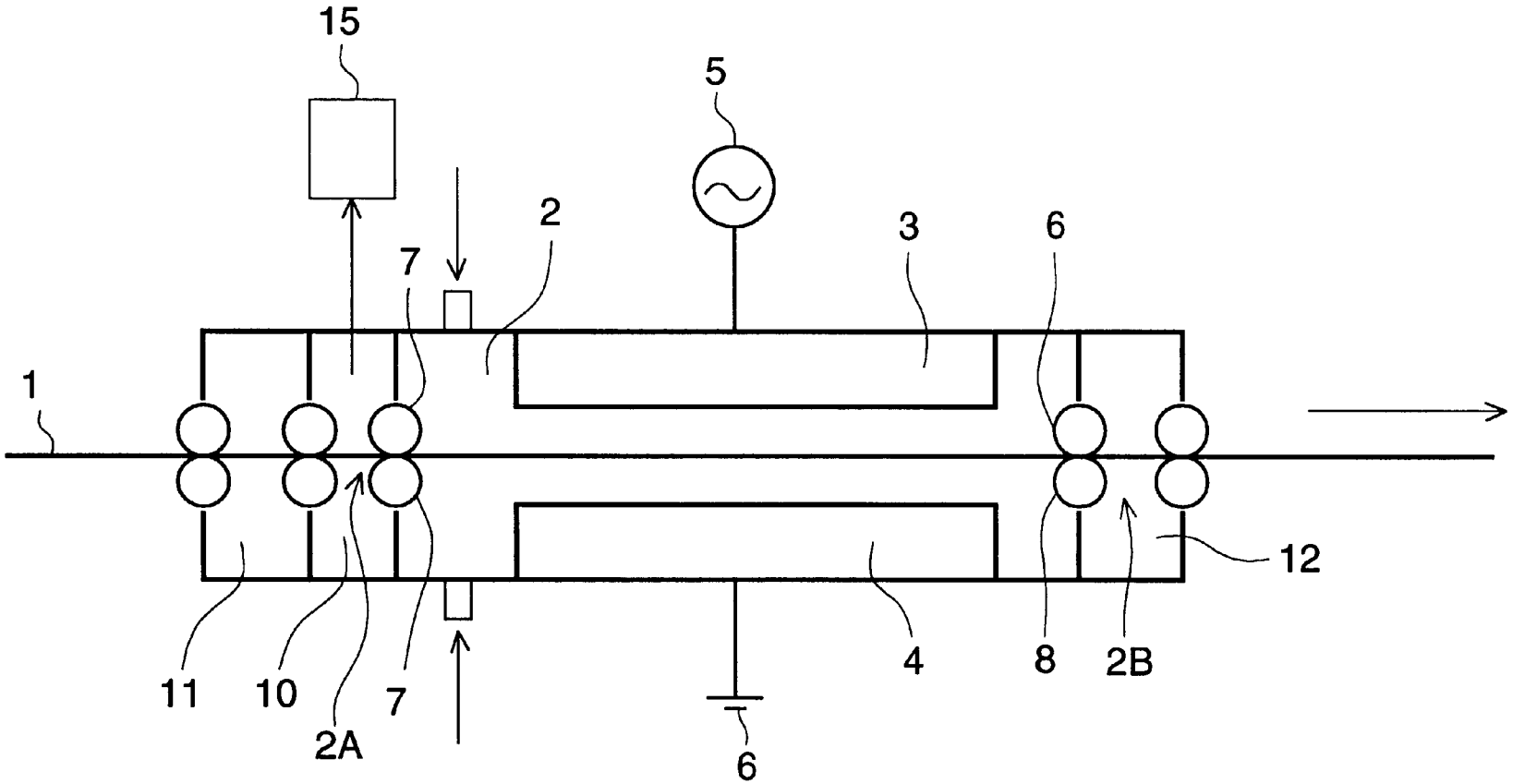
FIG. 3 is a schematic constitutional view of one embodiment of the first method and apparatus of the present invention.

FIG. 3 is a schematic constitutional view of the second method and apparatus.

As shown in FIG. 3, treatment section 2 in which a continually conveyed continuous support 1 is subjected to plasma treatment under normal atmospheric pressure or similar pressure is constituted by a partitioned treatment section having inlet 2B as well as outlet 2B for the support 1. In the following, the treatment section is described as the treatment section.

In the treatment section 2, plate electrodes 3 and 4 are provided. The constitution of said plate electrodes may the same as that employed in the first method and apparatus.

In the example shown in FIG. 3, spare section 10 adjacent to the treatment section 2 is provided on the substrate inlet side, and spare section 11 adjacent to said spare section 10 is provided. Spare section 12 adjacent to the treatment section 2 is also provided on the support outlet side.

When a spare section is provided, as shown in FIG. 3, an embodiment may be employed in which two spare sections are provided on the inlet side of the substrate and one spare section is provided on the outlet side. However, the embodiment is not limited to this, and an embodiment may be employed in which one spare section is provided on the inlet side of the support and one spare section is provided on the outlet side, or an embodiment may be employed in which two spare section are provided on the inlet side and no spare section is provided on the outlet side.

In any embodiment, it is necessary that the atmospheric pressure in th e treatment section is higher than that in a spare section which is adjacent to said treatment section. The pressure difference is preferably at least 0.03 mmAq. As described above by providing the pressure difference between the treatment section and the spare section, the mixing of external air is minimized. Thus it becomes possible to efficiently utilize reaction gas to further enhance the surface treatment effects.

Further, when at least two spare sections adjacent to the treatment section on the inlet side and at least two spare sections adjacent to the treatment section on the outlet side are provided, it is preferable that regarding the atmospheric pressure of spare section adjacent to each other, the atmospheric pressure adjacent to the treatment section is higher than the spare section adjacent to the spare section, and the pressure difference is preferably at least 0.03 mmAq. By providing the pressure differences among a plurality of spare sections adjacent to each other, the mixing of external air is effectively minimized. Thus it becomes possible to effectively utilize reaction gas to further enhance the desired surface treatment effects.

From the viewpoint of the efficient use of reaction gases as well as the enhancement of surface treatment effects, it is preferable that a spare section is filled with at least one reaction gas.

Further, in order to provide a plurality of spare sections and also to set the pressure differences, it is preferable to provide pressure reducing means 15. Cited as said pressure reducing means are a vacuum pump and the like.

It is necessary to provide a partition between the treatment section and the spare section, as well as between the spare sections. As a means for said partitioning, an embodiment is preferred in which paired nip rolls 7 and 7 are provided on the inlet side, and paired nip rolls 8 and 8 are provided on the outlet side, as shown in FIG. 3.

Such nip rolls exhibit functions for separation or partitioning while being in contact with a substrate. However, it is impossible to perfectly seal the partition between two sections. Therefore, a means, in which pressure differences are provided as proposed in the present invention, functions effectively.

Further, as the means for partitioning, an embodiment may be acceptable in which it maintains a specified distance from a substrate under no contact. As such a means, an air curtain system (not shown) and the like, may be employed. It is also preferable to employ units shown in FIGS. 10 and 11, described below. Further, when no spare section is provided, a partition between the treatment section and the exterior may be provided.

In FIG. 3, parts, which have the same reference numerals as those in FIG. 1, are constituted in the same manner as those in FIG. 1. Therefore, description of those is abbreviated herein. In order to carry out a treatment employing the apparatus shown in FIG. 3, first conveyed substrate 1 is introduced to treatment section 2. In said treatment section, a pulse electric field is applied to said substrate. Through such application, the support surface is subjected to plasma treatment and consequent surface treatment.

In the second method, during such a surface treatment, it is preferable that the ratio of a reaction gas in the treatment gases, enclosed in the treatment section 2, is at least 30 percent, and the atmospheric pressure in treatment section 2 is higher than that of the external pressure.

By setting higher atmospheric pressure in the treatment section 2 than the external pressure, the entrance of gas to the treatment section from the exterior is prevented. Thus, in accordance with specific requirements, it is possible to enclose only gas having elements employed for specified treatment (being elements which are to be introduced into a substrate) at high purity, and to carry out more efficient treatment. Further, by employing reaction gases having a ratio of at least 30 percent, it is possible to decrease the amount of inert gas and to carry out an efficient treatment at lower cost.

In the present invention, by employing an embodiment in which the atmospheric pressure in the treatment section 2 is at least 0.03 mmAq higher than the external pressure, it is possible to achieve maximum effects at the lowest level of air sealing.

Further, a previous charge eliminating treatment for the surface of a substrate and dust removal is preferably carried out to further enhance the uniform surface treatment. Employed as the charge eliminating means and dust removal means after the charge elimination are the same as those described the aforementioned first method.

The ratio of a reaction gas in the mixture of treatment gases enclosed in the treatment section 2 is to be at least 30 percent. Such reaction gases include nitrogen ($N_2$) gas, hydrogen ($H_2$) gas, ammonia ($NH_3$) gas, fluorine gas, steam, and the like. Gases are acceptable which can provide polar functional groups such as an amino group, a carboxyl group, a hydroxyl group, a carbonyl group, and the like, or chemically active groups. Specifically, when a hydrophilic treatment is carried out, it is preferred to introduce a hydroxyl group. Thus, it is preferable to employ mainly alcohol, $H_2O$, $O_2$, $CO_2$, and the like. When a hydrophobic treatment is carried out, it is preferable to employ fluorine-containing compounds (fluorine, organic fluoro compounds, and the like) and the like. Further, employed as reaction gases may be oxygen-containing compounds (oxygen, ozone, water, carbon monoxide, carbon dioxide, and in addition, alcohols such as methanol and the like, ketones such as acetone and the like, aldehydes, and the like), nitrogen-containing compounds (nitrogen, nitrogen-containing inorganic compounds such as ammonia, nitrogen monoxide, nitrogen dioxide, and the like, amine based compounds, other nitrogen-containing organic compounds, and the like) and the like.

Employed as gases, other than reaction gases, may be inert gases. Inert gases include argon (Ar), neon (Ne), helium (He), krypton (Kr), xenon (Xe), and the like.

In the present invention, it is preferable to employ a treatment gas which is previously prepared by mixing inert gases and reaction gases prior to the introduction of said gas into the treatment section 2. However, gases may be individually introduced so that the ambience between electrodes 3 and 4 in the treatment section is at the reaction gas ratio as described above.

In the embodiment described above, plate electrodes are employed. However, in lieu of these, preferably employed as electrodes are cylinder types, roll types, or gas flow type curved surface electrodes.

First, an example employing the cylinder type electrodes will be described.

Figure 4:
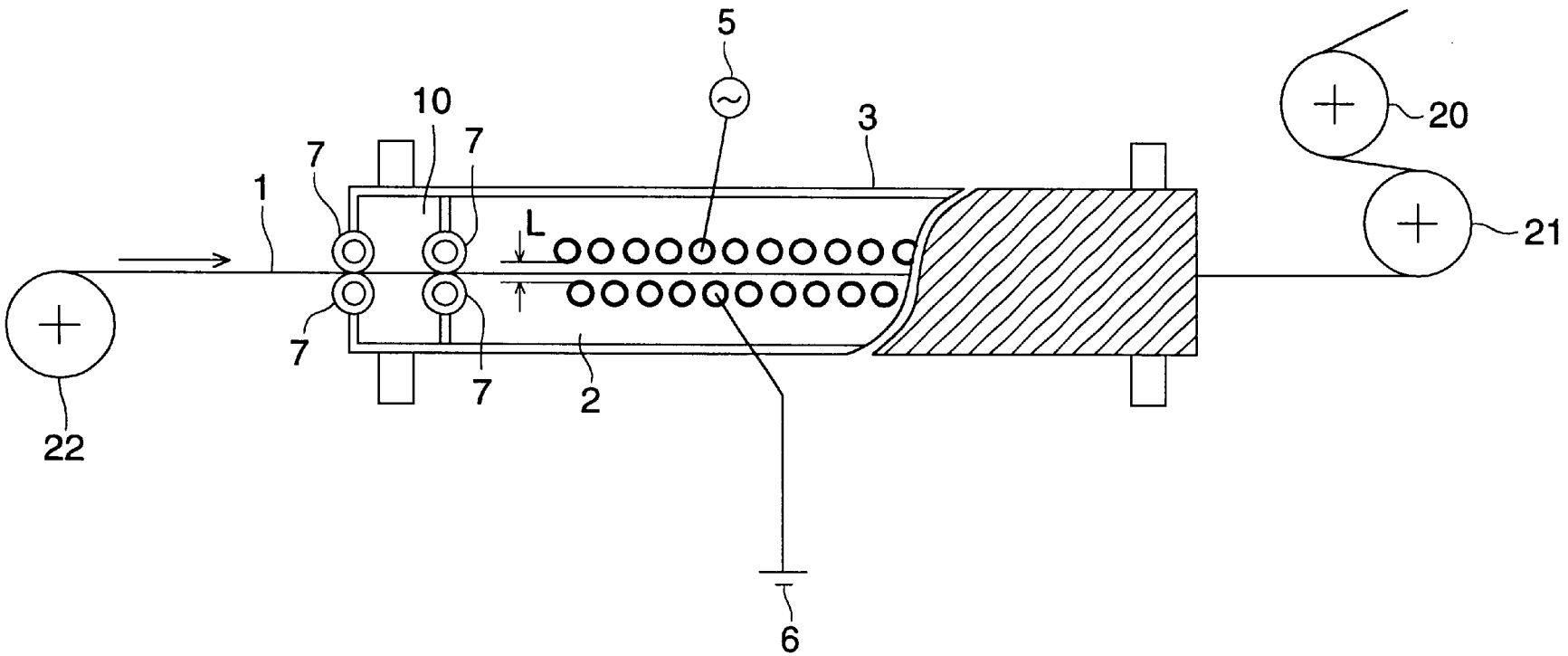
FIG. 4 is a schematic constitutional view showing an embodiment employing a cylinder type electrode.

FIG. 4 is a schematic constitutional view showing another preferable embodiment of the second apparatus. The embodiment shown in FIG. 4 is an example in which the plate electrodes employed in the embodiment shown in FIG. 3 is replaced with a cylinder type electrode.

Further, of reference numerals employed in FIG. 4, parts having the same reference numerals shown in FIG. 3 have the same configuration. Therefore, description of those is abbreviated.

In the present embodiment, a plurality of cylindrical electrodes 3 are parallelly arranged on both sides of substrate 1. As shown in FIG. 4, said electrodes may be parallelly provided in staggered arrangement. However, they may be in an arrangement. Gap L between the electrodes is expressed as the distance between the lowest surface of the electrode over substrate 1 and the highest surface of the electrode below said substrate 1. The distance between opposed electrodes may be the same or different.

The cylindrical electrode has a double tube structure in which an electrically conductive metal is arranged in the interior and a dielectric is arranged as the exterior. Employed as the configuration of the electrically conductive metal, as well as the dielectric, may be those described above. Further, a metal tube, as well as a rod, may be inserted in a ceramic pipe.

Further incidentally, reference numerals 20, 21, and 22 are conveyance rolls.

By employing such a cylindrical electrode, gases are readily introduced into the gap between electrodes, and the contact efficiency of reaction gases with the electrode is enhanced. As a result, surface treatment effects are also enhanced. Further, it is a simply structure, is excellent in interchangeability, and makes it possible to carry out treatment at lower cost. In addition, excellent effects are exhibited at relatively high speed conveyance of the support.

In the following, an example employing the roll type electrodes is described.

FIGS. 5 through 8 are schematic constitutional views showing other preferred embodiments of a second apparatus. The embodiments shown in FIGS. 5 through 8 are examples in which the plate electrodes employed in the embodiment shown in FIG. 3 are replaced with roll type electrodes.

Further, regarding the reference numerals, parts having the same reference numerals as those shown in FIG. 3 have the same configuration. Therefore, description on those is abbreviated.

Figure 5:
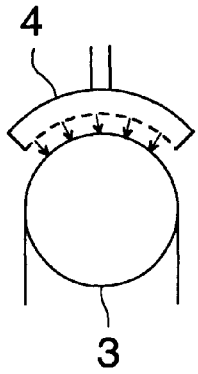
FIG. 5 is a schematic constitutional view showing an embodiment employing a roll type electrode.
Figure 5:
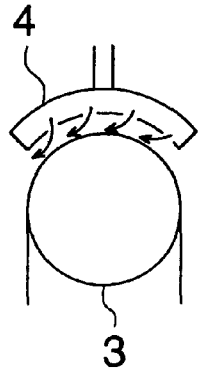

In the embodiments shown in FIGS. 5(*a*) and 5(*b*), electrode 3 on one side is a cylindrical roll type electrode, which rotates by itself, and support 1 is conveyed while being in contact with the surface of said electrode. In said electrode, a dielectric is provided on the surface of a roll-like electrically conductive metal.

On the other hand, electrode 4 is a curved surface electrode having a surface parallel to the curved surface of the roll type electrode.

Said electrodes 3 and 4 are arranged as shown in FIG. 5, and gas supplied from a supply opening (not shown) on the side of curved surface electrode 4 are ejected from a plurality of holes (not shown) as shown by the arrow.

The ejecting direction of the gas may be in the radius direction of the roll as shown in FIG. 5(*a*). However, as shown in FIG. 5(*b*), said direction may be in the tangential direction of the roll. Further, the gas ejection hole may be a circular hole or a slit.

When the gas are ejected from a plurality of holes, the surface of a substrate, which is conveyed by said gases, is sufficiently covered with said gases which make it possible to carry out stabilized discharge. In addition, because the support is brought into contact with the other roll electrode and is held by it, the curved surface electrode can further approach the support. Thus the surface treatment is stabilized, and treatment effects are enhanced. Further, because the roll electrode rotates, the support suffers neither scratches nor abrasion during its conveyance. Compared to the embodiment shown in FIG. 3, said embodiment exhibits advantageous effects in which the number of nip rolls can decrease. Said embodiment also exhibits excellent effects during the relatively high speed conveyance of the support.

Figure 6:
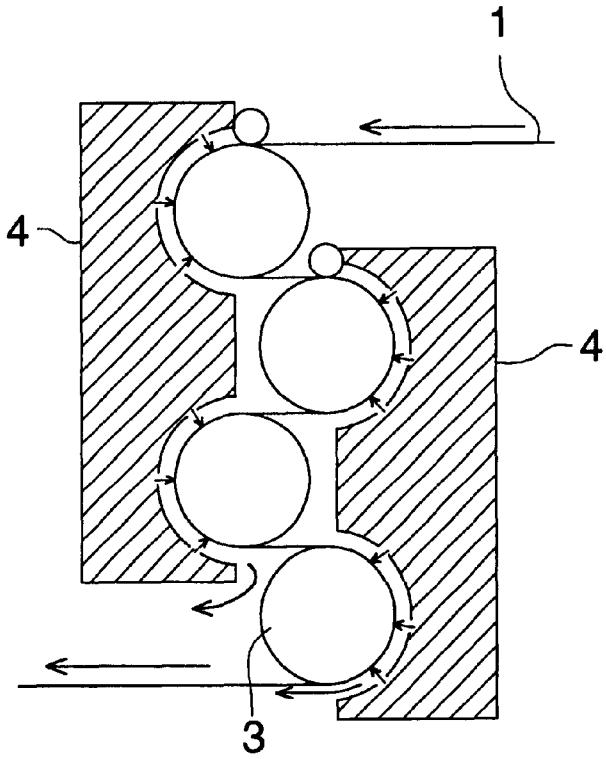
FIG. 6 is a schematic constitutional view showing an embodiment employing a roll type electrode.

An embodiment shown in FIG. 6 is an example in which a treatment section is formed employing the combination of a plurality of roll type electrodes and the curved surface electrode. Said embodiment shows a practical apparatus. Further, said embodiment exhibits excellent effects during the relatively high speed conveyance of the support.

Figure 7:
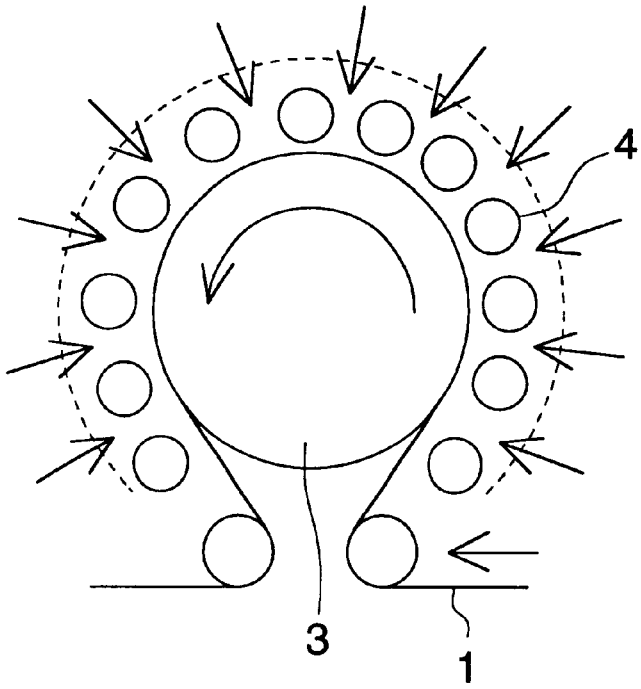
FIG. 7 is a schematic constitutional view showing an embodiment employing a roll type electrode.
Figure 8:
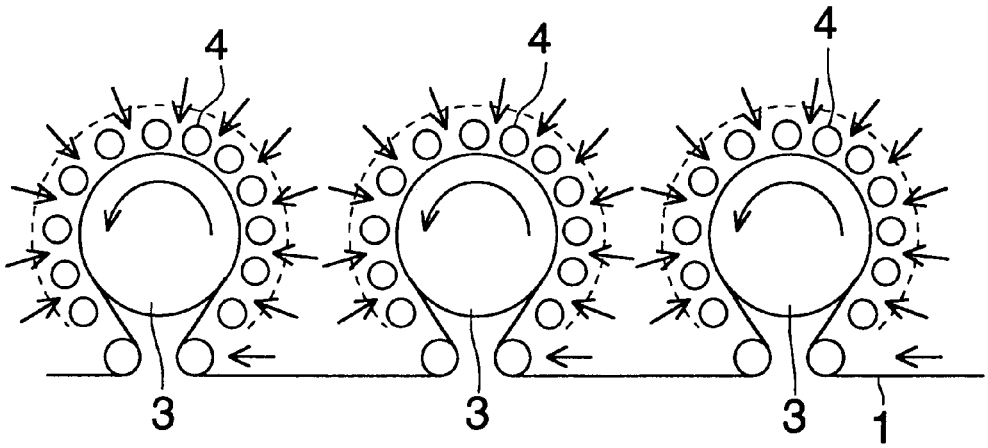
FIG. 8 is a schematic constitutional view showing an embodiment employing a roll type electrode.

An embodiment shown in FIG. 7 is an example in which the roll type electrode and a plurality of cylinder type electrodes are combined. An example shown in FIG. 8 is one in which a plurality of apparatuses having the embodiment shown in FIG. 7 are provided and a practical apparatus is constituted. Further, of reference numerals shown in FIGS. 7 and 8, parts having the same reference numerals as those, shown in FIG. 3, have the same. constitution. Thus the description on those is abbreviated. Further, these embodiments also exhibit excellent effects during the high speed conveyance of the substrate.

In the following, an example, in which the gas flow type curved surface electrode is employed, is described.

Figure 9:
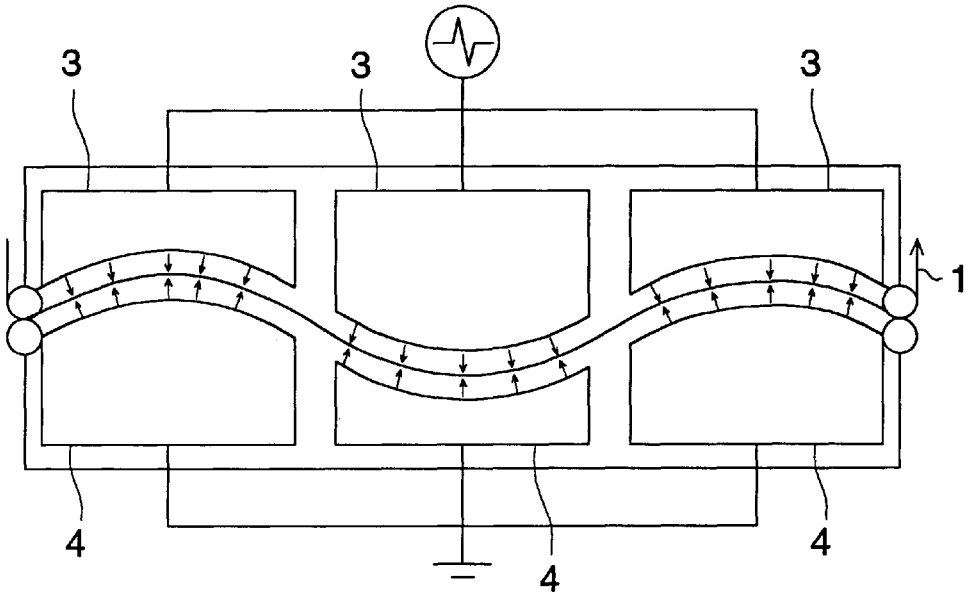
FIG. 9 is a schematic constitutional view showing an embodiment employing a gas flow type curved surface electrode.

FIG. 9 is a schematic constitutional view showing another preferred embodiment of a second apparatus. The embodiment shown in FIG. 9 is an example in which the plate electrode, employed in the embodiment shown in FIG. 3, is replaced with the curved surface electrode.

Further, regarding reference numerals shown in FIG. 9, parts having the same reference numerals as those in FIG. 3 have the same constitution. Thus description of those is eliminated.

Electrodes 3 and 4 in the present embodiment are parallel to the surface of substrate 1. When viewed from the direction orthogonal to the conveying direction of the support, with the curved surface electrode, the cross-sectional shape of the facing surface is a curved surface. By arranging a plurality of said electrodes 3 and 4 in the conveyance direction, they are constituted so that the conveyed substrate 1 moves zigzag. Accordingly, the gas supplied from a supply opening (not shown) is ejected from a plurality of openings (not shown) as the arrow shows. It is preferable that the ejection is uniformly carried out. The gas ejection opening may be a circular hole or a slit.

When the gas is ejected from a plurality of openings, support 1 conveyed by said gas is conveyed to a gap between paired electrodes 3 and 4 set at a distance of no more than 10 mm under non-contact. In such a embodiment, said gas is directly ejected to the gap between paired electrodes. As a result, the diffusion of the ejected gas is enhanced to make it possible to obtain stable discharge. Further, it is possible to simultaneously treat both sides of the substrate 1. Accordingly, the higher treatment efficiency is achieved.

In said embodiment, the substrate 1 is conveyed zigzag. As a result, compared to a straight conveyance (a conveyance shown in FIG. 3), stable conveyance can be achieved. Thus it is possible to further decrease the gap between electrodes to enhance the discharge effects. In addition, said embodiment exhibits excellent effects during the relatively high speed conveyance of a substrate.

Further, in the embodiment shown in FIG. 9, zigzag conveyance is carried out. However, if an embodiment makes it possible to carry out non-contact conveyance, further improved various embodiments may be employed.

Figure 10:
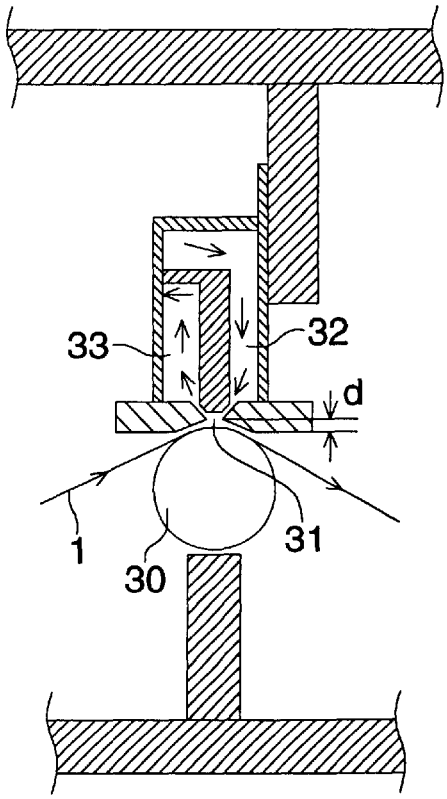
FIG. 10 is a schematic constitutional view showing an example of a device to enhance air sealing.
Figure 11:
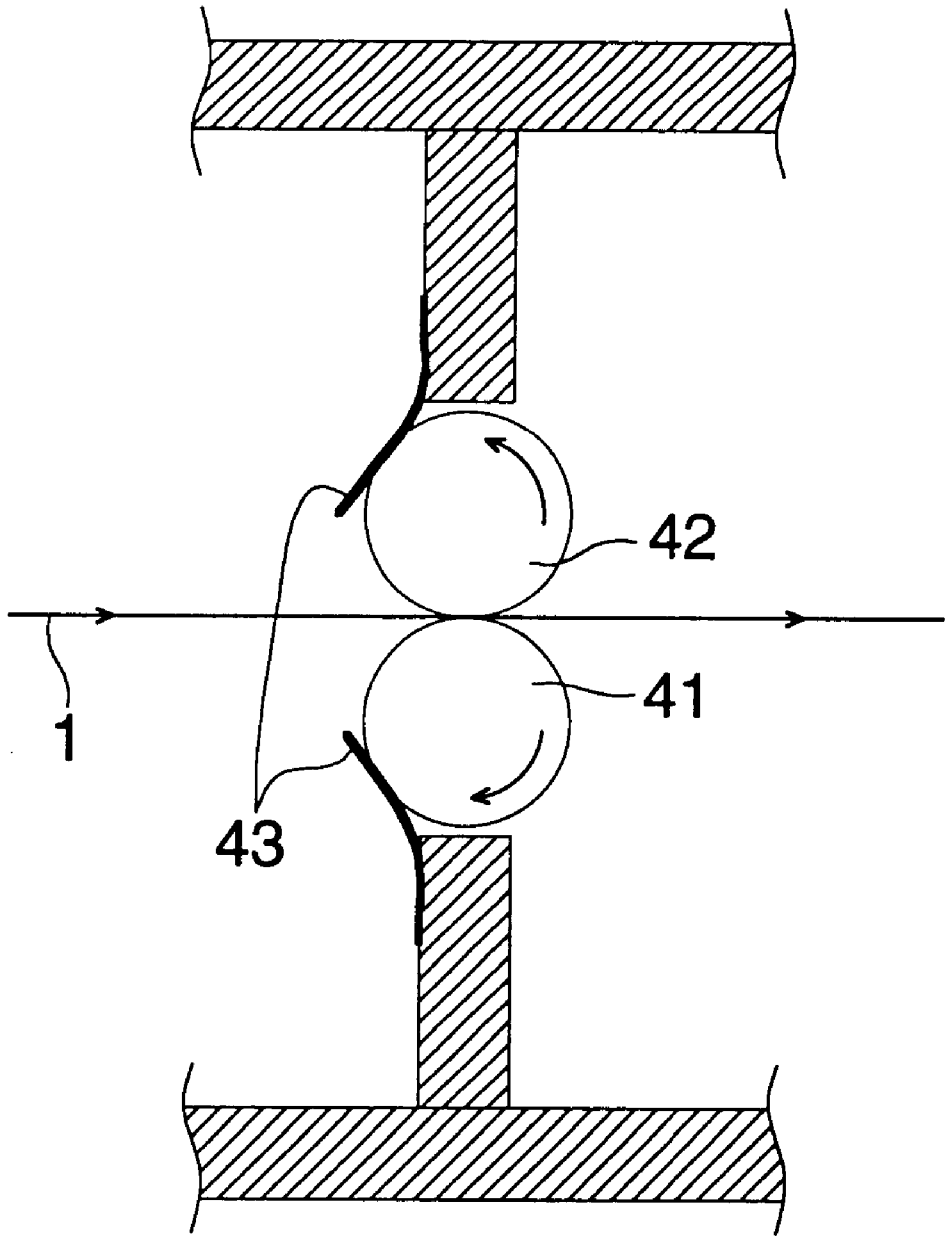
FIG. 11 is a schematic constitutional view showing an example of another device to enhance air sealing.

In the apparatus descried above, in order to further enhance effects to intercept air accompanied with a substrate, apparatuses shown in FIGS. 10 and 11 are preferably employed.

FIG. 10 is an enlarged view of a gas flow blade unit. The gas flow blade unit is constituted so that distance d between the surface of substrate 1 conveyed upper conveyance roll 30 and slit section 31 can be finely adjusted. Pressurized gas, which is ejected from the interior (the right side in FIG. 10) of the gas flow blade unit, is ejected to the surface of a support through slit 31. At that time, the discharge angle is set so as to be opposite to the conveying direction of the substrate 1. Said angle is preferably between 60° and 90°. The gas may be ejected only from the slit. However, when the ejected gas is subjected to pressure decrease and suction in the direction opposite to the conveying direction of the support 1 so that that gas flow 33 is formed, it is possible to more effectively carry out the required treatment. The width of the slit 31 is preferably narrower, and is preferably no more than 2.0 mm. It is possible to apply said embodiment to the apparatus shown in FIG. 1. Said embodiment may be employed as a partition between the treatment section and the spare section, and also between the spare section and another spare section.

FIG. 11 is an enlarged view of one part of an apparatus in which a film-shaped blade to enhance air tightness is installed. Besides the gap through which substrate 1 passes, openings are eliminated to enhance air sealing in such manner that film-shaped blade 43 is brought into contact with the rear side of a roll such as conveying roll 41 and free roll 42 which is employed as a partition so that said blade slides on the roll. The conveying roll 41 and the free roll 42 may be paired to form nip rolls. Further, when there is no roll over the support 1, the conveying roll 41 is only employed.

In the following, a third method and apparatus will be described.

Figure 16:
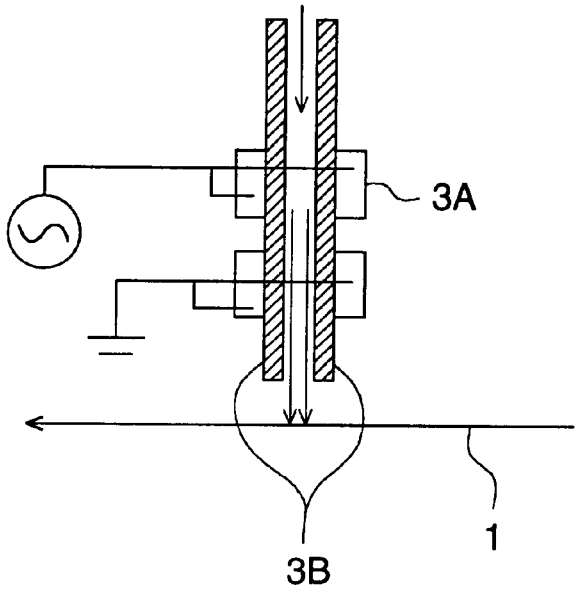
FIG. 16 is a schematic view of one of plasma treating.

In FIG. 16, base material 1 is not conveyed into a gap between two facing dielectrics, but is conveyed into the exterior of the dielectrics. The surface of the two facing dielectrics makes a right angle with the surface of the base material. Gas is introduced into the gap between the two facing dielectrics. The gas may be comprised of air. An electric filed is applied to the gas which has been introduced into a gap between said two facing dielectrics, which generates a discharge plasma. The resulting discharge plasma is then introduced into the base material. By providing such a constitution as described above, the electric filed is not directly applied to the base material. As a result, the base material may be less damaged. Further, when said constitution is employed, there is no base material in the gap between the two facing dielectrics. Thus, the electric field is readily formed, and it is possible to increase the ratio of the gas which is converted into plasma. As a result, it is possible to more efficiently obtain more excellent surface modifying effects.

Figure 17:
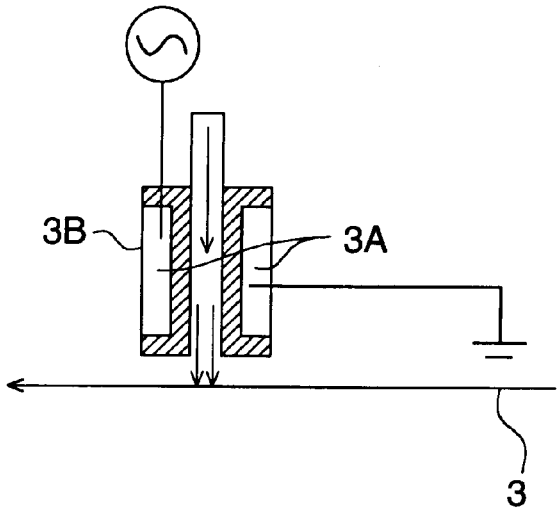
FIG. 17 a schematic view of one of plasma treating.

Further, in the same manner as shown in FIG. 17, the direction of the generated electric field may be altered, compared to FIG. 16.

Figure 18:
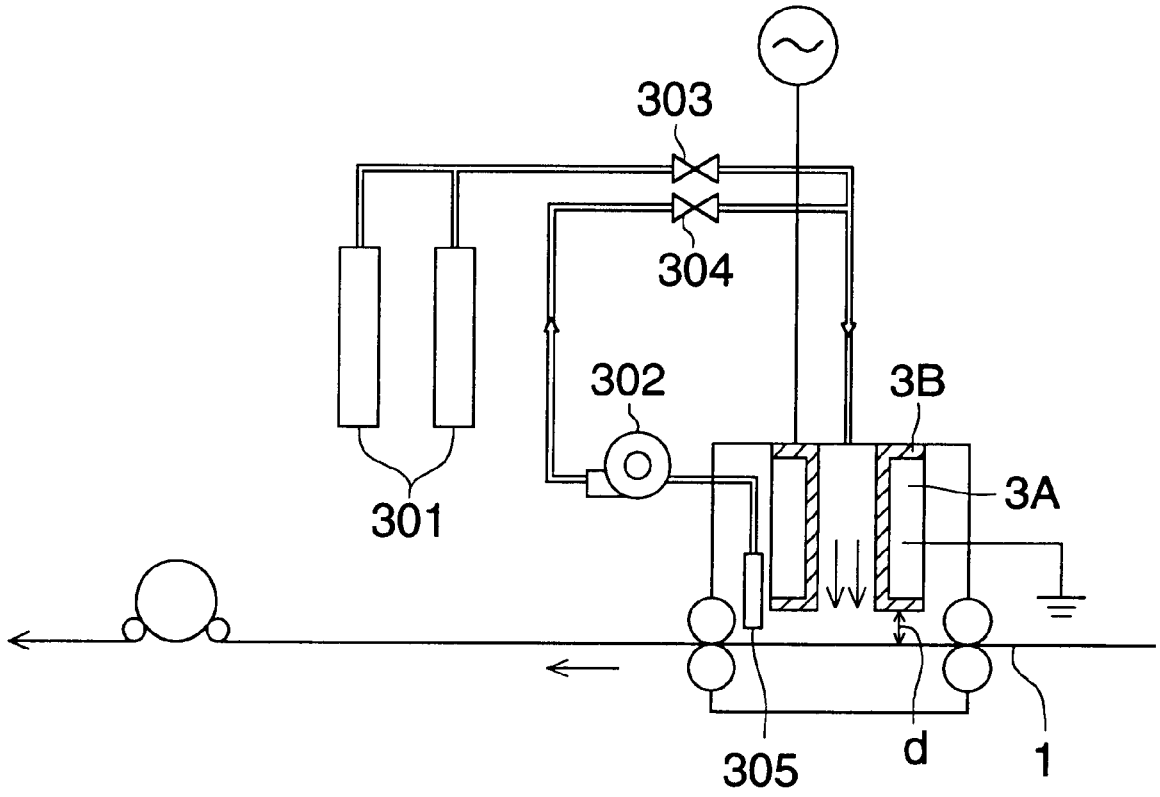
FIG. 18 a schematic view of one of plasma treating.

FIG. 18 shows one embodiment of the constitution shown in FIG. 17.

In a section which exclude external air, discharge plasma is formed. A base material is continually introduced into said section by employing paired nip rolls, and the resulting discharge plasma is then introduced into the base material. At the entrance (the inlet for the introduction of the base material) of the section, said paired nip rolls serve to decrease the introduction of external air as well as the exhaust of the discharge plasma to the exterior. Further, at the exit (the outlet for the base material to the exterior), paired nip rolls are also provided which serves to decrease the introduction of external air as well as the exhaust of the discharge plasma to the exterior in the same manner as at the entrance.

Furthermore, in the present apparatus, a circulation pipe, which circulates the discharge plasma, as well as a fresh gas introducing pipe, which is employed to introduce gas, which is not converted to plasma, is provided. The circulation pipe is a pipe to circulate the discharge plasma so that the discharge plasma sucked from a gas sucking hole provided in the section can be exhausted from the gas exhausting hole provided on the entrance side of the gap between solid dielectrics. The discharge plasma exhausted from the gas exhausting hole is again subjected to plasma formation in the gap between the solid dielectrics and is introduced onto the base material. Further, the fresh gas introducing pipe is a pipe to introduce gas so that the cylinder gas, which is not subjected to plasma formation, can be exhausted from the gas exhausting hole provided on the entrance side of the gap between the solid dielectrics. The gas, which is not subjected to plasma formation and is exhausted from the gas exhausting hole, is subjected to plasma formation in the gap between solid dielectrics, and is introduced into the base material.

As described above, the discharge plasma is reused through circulation, and the gas, which is not converted to plasma, is introduced so that it can be employed to form the discharge plasma. In such a manner, it is possible to reduce gas waste and to more efficiently obtain more excellent surface modifying effects.

A fourth method and apparatus will be described below.

Figure 19:
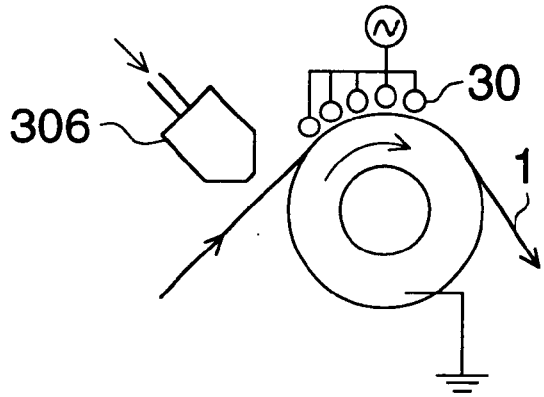
FIG. 19 is a schematic view of a plasma treatment apparatus provided in a tightly sealed section.
Figure 20:
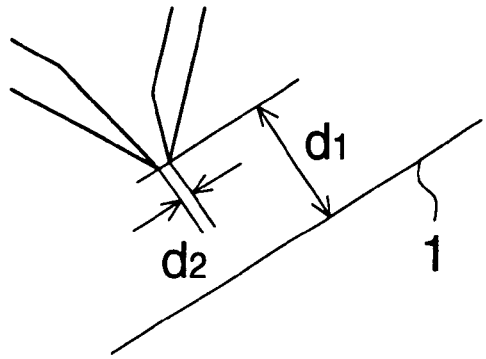
FIG. 20 is a schematic view of a gas ejection means with a nozzle having a gas ejection slit.

FIG. 19 shows a plasma treatment apparatus provided in a tightly sealed section.

A continually conveyed base support is subjected to application of the electric field which can be formed between the grounded roller and the electrode. A gas ejecting means, which is provided with a nozzle having a gas ejecting slit, is provided on the base material conveying route just before the electric field (just before the electrode).

In such a constitution described above, gas ejected from the slit of the gas ejecting means is introduced into the interior of the continually conveyed base material. Immediately after that, the gas, which is introduced into the interior of the base amterial, is subjected to plasma formation employing the electric field generated between the electrode and the roller. Thus, the base material is subjected to plasma treatment.

As described above, immediately after the ejected gas is introduced into the base material, the plasma treatment is carried out. Thus the gas is more readily introduced into the base material. As a result, it is possible to efficiently carry out the plasma treatment and to obtain excellent surface modifying effects.

Further, the shape of the nozzle is preferably a slit type or a porous type. Still further, during the gas ejection, the inner pressure of the nozzle is preferably at least 15 mmAq for the efficient introduction of the gas into the base material. In order to enhance the efficiency of the introduction of gas into the base material, it is preferable that the distance between the nozzle tip and the base material is no more than 5 mm and the gas ejecting speed at the nozzle tip is at least 15 m/second.

The surface-treated substrates of the present invention include those which are treated by all methods and apparatuses described above.

Plasma generation during the surface treatment of the present invention can be detected by measurements employing an optical emission spectroscopy (abbreviated as OES) or a photoelectron spectroscopy (abbreviated as PES).

An active group formed on the surface of a substrate employing the discharge plasma treatment of the present invention can be detected employing the photoelectron spectroscopy (ESCA). For example, it is possible to employ an ESCAKLAB-200R manufactured by VG Co.

Substrates to which the present invention may be applied will be described below.

In the present invention, it is preferable to employ a substrate prepared by applying a coating composition prepared by dispersing silica into PVA onto a support such as film selected from polyethylene terephthalate, polyethylene naphthalate, polyethylene, and polypropylene or paper.

EXAMPLES

A substrate was subjected to plasma treatment employing the conditions described below.

(1) Power Source

Condition (1) high frequency power source manufactured by Shinko Denki Co. SPG50-25000

Condition (2) impulse type high frequency high voltage power source manufactured by Haiden Kenkyusho Co. PHF-6

(2) Treatment Section

An apparatus provided with the type of a treatment section shown in FIG. 3 (under the condition of no gas purging, the treatment section is employed without air sealing)

| | |
|---|---|
| Capacity of treatment section | 2,000 $m^3$ |
| Electrode area | 250 × 500 mm |
| Dielectric | 1 mm thick alumina ceramics |
| Gap between electrodes | 3 mm |

(3) Discharge Conditions

| | |
|---|---|
| Frequency | 50 KHz |
| Output | 10 $kW/m^2$ |
| Treatment time | 3 seconds |

(4) Treatment Gas Conditions

Condition (1) gas purging Ar 80%, $O_2$ 20%

Condition (2) gas purging Ar 40%, $O_2$ 60%

Condition (3) gas purging Ar 50%, $CF_4$ 50%

Condition (4) gas purging $O_2$ 100%

Condition (5) gas purging $N_2$ 100%

Condition (6) discharge under atmosphere (no gas purging)

(5) Employed Substrates

A gelatin layer was applied as a sublayer to a Konica RC paper prepared by applying a 5 $\mu$m thick polypropylene to both surfaces of pulp-based paper. Then a coating composition prepared by dispersing silica into PVA was applied to the resulting substrate so as to form four layers and dried. The resulting substrate was employed as a substrate (hereinafter referred to as ink jet paper manufactured by Konica, QP manufactured by Konica, or simply ink jet paper).

Example 1

An ink jet paper (QP manufactured by Konica) was placed in a treatment apparatus, and discharge was carried. A definite amount (2 μL of PMIC1C, dense magenta, manufactured by Epson) of liquid droplets was dropped onto the treated ink jet paper employing a contact angle measuring apparatus DAT1100MkII manufactured by Fibro Co. (in Sweden), and time until the volume of the residual liquid on the surface of the surface layer became 0.5 μL. The results were shown below.

TABLE 1

| | Employed Power Source | Purging time | Gas Condition | Result (in second) |
|---|---|---|---|---|
| Comparative Example | | no treatment | | 4.3 |
| Present Invention 1 | Condition 1 | 5 minutes | Condition 1 | 1.0 |
| Present Invention 2 | Condition 1 | 10 minutes | Condition 1 | 0.5 |
| Present Invention 3 | Condition 1 | 3 hours | Condition 1 | 0.06 |
| Present Invention 4 | Condition 2 | no purging | Condition 2 | 0.2 |
| Present Invention 5 | Condition 2 | no purging | Condition 4 | 0.04 |
| Present Invention 6 | Condition 2 | no purging | Condition 5 | 0.1 |
| Present Invention 7 | Condition 2 | no purging | Condition 6 | 0.1 |

When the amount of the residual ink on the surface of the surface layer becomes 0.5 μL, lateral blotting phenomenon of a droplet, which is ejected to a spot adjacent to other droplets, is retarded to substantially minimize the lateral blotting. However, when no treatment is carried out, at least 4 seconds are required to reach said value.

Contrary to this, it is found that all those, which were subjected to plasma treatment, exhibited shorter time and the rate of absorption was enhanced.

Particularly, as shown in present inventions 2 and 3, the longer the purging time, the more modification effects were enhanced.

Further, when the pulse type power source is employed, major surface modifying effects are obtained without the gas purging.

Generally, it is found that when an ink jet paper, in which the interaction between droplets which are ejected near to each other has not been eliminated, is subjected to plasma treatment, the rate of ink absorption markedly increases to enhance the image forming capability.

Example 2

A plasma treatment was carried out under the same conditions as the aforementioned Present Invention 1, except that the power source was replaced with a corona power source GI-020 Type manufactured by Kasuga Denki Co. Then it was confirmed that the time was 2.3 seconds and the image forming capability was further enhanced compared to the untreated.

Example 3

An ink jet paper (QP manufactured by Konica) was placed in a treatment apparatus, and was subjected to discharge under the same conditions as Present Invention 1 in Example 1 after purging for 5 minutes under Gas Condition (3). A definite amount (2 μL of PMIC1C, dense magenta, manufactured by Epson) of liquid droplets was dropped onto the treated ink jet paper employing a contact angle measuring apparatus DAT1100MkII manufactured by Fibro Co. (in Sweden), and the degree of the spread of the dropped ink diameter was observed.

TABLE 2

| | 1.0 μL | | 1.5 μL | |
|---|---|---|---|---|
| | Immediately after Dropping | After Drying | Immediately after Dropping | After Drying |
| Plasma treatment | 4 mm | 4 mm | 5 mm | 5 mm |
| Non-Treatment | 4 mm | 6 mm | 5 mm | 8 mm |

According to the results in Table 2, it is possible to confirm that the spread (lateral blotting) of an ink droplet after the ejection onto the ink jet paper surface is minimized due to the plasma treatment.

Example 4

The ink jet paper, which had been subjected to plasma treatment employing Gas Condition (4) in Example 1, was further subjected to plasma treatment under gas conditions of Ar 10%, CF4 10%. The resulting ink jet paper exhibited excellent results in the rate of water absorption as well as blotting resistant properties.

TABLE 3

| | Employed Power Source | Purging Time | Gas Condition | Result (in second) |
|---|---|---|---|---|
| Present Invention 8 | Condition 2 | no purging | Condition 4 | 0.04 |

Example 5

A rolled 400 mm wide ink jet paper (QP manufactured by Konica) with a length of 300 m was placed in a pressure-reducible purging section, and gas was enclosed under Gas Condition (4) while maintaining the interior pressure at 20 Torr. After 5 minutes, said ink jet paper was removed from the purging section, and was unwounded from the treatment line over about 10 minutes. Then said paper was subjected to discharge treatment under the above-described conditions while being conveyed and passed through the interior of the treatment section. A definite amount (2 μL of PMIC1C, dense magenta, manufactured by Epson) of liquid droplets was dropped onto the treated ink jet paper employing a contact angle measuring apparatus DAT1100MkII manufactured by Fibro Co. (in Sweden), and the results were obtained which were almost the same as Example 1 of Present Invention 7.

Example 6

An ink jet paper (QP manufactured by Konica) was placed in a treatment apparatus, and discharge was carried out one hour after enclosing gas. Further, the plasma treatment was carried out while varying the humidity conditions of the treatment gases. A definite amount (2 μL of PMIC1C, dense magenta, manufactured by Epson) of liquid droplets was dropped onto the treated ink jet paper employing a contact angle measuring apparatus DAT1100MkII manufactured by Fibro Co. (in Sweden), and a time until the volume of the residual liquid on the surface became 0.5 μL. The results were shown below.

TABLE 4

| | Employed Power Source | Purging Time | Gas Condition | Absolute Humidity | Result (in second) |
|---|---|---|---|---|---|
| Comparative Example | Condition 2 | no purging | Condition 6 | 0.001 | 0.40 |
| Present Invention 9 | Condition 2 | no purging | Condition 6 | 0.003 | 0.14 |
| Present Invention 10 | Condition 2 | no purging | Condition 6 | 0.007 | 0.10 |
| Present Invention 11 | Condition 2 | no purging | Condition 6 | 0.011 | 0.04 |
| Present Invention 12 | Condition 2 | no purging | Condition 6 | 0.013 | 0.02 |

According to the results in Table 4, it reveals that by varying the humidity conditions, the image receiving properties are further improved.

Example 7

The apparatus (electrodes and dielectrics) employed in Example 1 was arranged approximately perpendicular to a base material as shown in FIG. 18. Then a definite amount of a mixed gas was introduced into the gap between electrodes, and discharge between the electrodes was carried out. The activated gas was then blown onto the base material. The treatment section, the power source, the discharge conditions, the treatment gas conditions, and the conditions applied to the employed base material were the same as Example 1. Further, the distance d (the distance between the position of the nearest dielectric from the base material and the base material) between the dielectric and the base material was 2 mm, while the inner pressure in the treatment section was 3 mmAq. In the same manner as Example 1, a definite amount (2 μL of PMIC1C, dense magenta, manufactured by Epson) of liquid droplets was dropped onto the treated ink jet paper employing a contact angle measuring apparatus DAT1100MkII manufactured by Fibro Co., and time until the volume of the residual liquid on the surface became 0.5 μL. was measured. Table 5 shows the results.

TABLE 5

| | Employed Power Source | Purging Time | Gas Condition | Amount of Gas Introduced | Result (in second) |
|---|---|---|---|---|---|
| Comparative Example | No treatment | | | | 4.3 |
| Present Invention 1 | Condition 1 | 5 min | Condition 1 | | 1.0 |
| Present Invention 7 | Condition 2 | No | Condition 6 | | 0.1 |
| New Example 1 | Condition 1 | No | Condition 1 | 3L/min/cm | 1.6 |
| New Example 2 | Condition 2 | No | Condition 6 | 10L/min/cm | 0.2 |

As described above, in the present example, it is possible to obtain excellent surface modifying effects, while decreasing damage to the base material.

Further, experiments were carried out in the same conditions as New Example 2 (New Example 2 in Table 5), except that the gap of a gas exhausting opening (among slits formed by two dialectics, the opening from which plasma gas is exhausted) was adjusted to 0.3 mm, and by adjusting the inner pressure of the treatment section to 30 mmAq, gas was jetted onto the base material. Table 7 shows the experimental results.

TABLE 7

| | Employed Power Source | Purging Time | Gas Condition | Amount of Gas Introduced | Result (in second) |
|---|---|---|---|---|---|
| New Example 3 | Condition 1 | No | Condition 6 | 10L/min/cm | 0.02 |

As described above, by providing a gas jet onto the base material, it is possible to efficiently obtain excellent surface modifying effects which reach the interior of voids.

Table 6 shows the treatment results obtained by employing the apparatus illustrated in FIG. 19. Further, the used power source was the same as that in Condition (1), the gas condition was the same as (1), and the other conditions were the same as Example 1. In the same manner as Example 1, a definite amount (2 μL of PMIC1C, dense magenta, manufactured by Epson) of liquid droplets was dropped onto the treated ink jet paper employing a contact angle measuring apparatus DAT1100MkII manufactured by Fibro Co., and time until the volume of the residual liquid on the surface became 0.5 μL. was measured.

TABLE 6

| | | Gas Introducing Condition | | | Result |
|---|---|---|---|---|---|
| | Purging Time | Gap | Slit gap | Pressure in Slit | (in second) |
| Present Invention 1 | 5 min | | | | 1.0 |
| Present Invention 2 | 10 min | | | | 0.5 |
| Present Invention 3 | 3 hr | | | | 0.06 |
| New Example 1 | No | 5 mm | 0.5 mm | 30 mmAq | 0.5 |
| New Example 2 | No | 1 mm | 0.5 mm | 30 mmAq | 0.1 |
| New Example 3 | No | 1 mm | 0.1 mm | 84 mmAq | 0.04 |
| New Example 4 | No | 1 mm | 0.1 mm | 84 mmAq | 0.04 |

As shown above, in the present example, by providing a gas jet, it is unnecessary to spend a time for purging. Furthermore, because gas can be efficiently included into the interior of voids, it is possible to obtain more excellent surface modifying effects.

According to the present invention, it is possible to provide a surface treatment method of a substrate, which is lower in cost and excellent in productivity, and an apparatus thereof, and to obtain the surface modifying effects of said substrate even during relatively high speed conveyance.

Specifically, it is possible to markedly improve the image receiving properties of an ink jet recording medium and to achieve recording of highly detailed images.

Further, by employing a pulse type power source, it is possible to carry out a plasma treatment under an atmosphere and to enhance the treatment efficiency.

Still further, by controlling the humidity in a treatment gas, it is possible to control the treatment efficiency, as well as the applied degree of hydrophilicity and hydrophobicity, and to produce ink jet recording media having various performances.

By carrying out the production of the ink jet recording media employing a continual process, it is possible to achieve efficient surface modification at a high speed.

What is claimed is:

1. A surface treatment method of a substrate having a layer with voids provided on a support, said method comprising, in sequential order:

first, treating said substrate to a first plasma treatment such that said layer with voids becomes hydrophilic; and second, treating said substrate to a second plasma treatment such that the surface of the layer with voids becomes hydrophobic.

2. The surface treatment method of claim 1 comprising charging gas into said layer with voids, before said first plasma treatment is carried out.

3. The surface treatment method of claim 2 wherein said gas is charged in said layer with voids by placing said substrate in a gas atmosphere.

4. The surface treatment method of claim 3 wherein the layer with voids is suspended in a gas chamber.

5. The surface treatment method of claim 2 wherein said gas is charged in said layer with voids while conveying said substrate in an ejected gas atmosphere.

6. The surface treatment method of claim 1 wherein said first plasma treatment treats the interior of said voids.

7. The surface treatment method of claim 1 wherein said second plasma treatment treats the surface of said layer with voids.

8. The surface treatment method of claim 1 wherein, in said first plasma treatment, a gas in the plasma state is charged into said layer with voids.

9. The surface treatment method of claim 1 wherein said first plasma treatment is carried out under an atmosphere containing an inert gas and a reaction gas.

10. The surface treatment method of claim 1 wherein said first plasma treatment is carried out under a gas being able to provide polar functional groups.

11. The surface treatment method of claim 1 wherein said second plasma treatment is carried out under a gas having a fluorine-containing group.

12. The surface treatment method of claim 1 wherein said layer with voids is formed by coagulating particles.

13. The surface treatment method of claim 1 wherein said layer with voids is provided by coating.

14. The surface treatment method of claim 1 wherein said layer with voids is roughened by employing said first plasma treatment.

15. The surface treatment method of claim 1 wherein said first plasma treatment is carried out by employing plasma generated in a pulse electric field.

16. The surface treatment method of claim 1 wherein said substrate further comprises a subbing layer between said support and said layer with voids.

17. The surface treatment method of claim 11 wherein the substrate is ink-jet paper.

18. The surface treatment method of claim 1 wherein said first plasma treatment is carried out by employing corona discharge.

19. The surface treatment method of claim 1 wherein said first plasma treatment is carried out under a pressure of 100 to 800 Torr by employing glow discharge.

20. A production method of an ink jet paper having a layer with voids on a support comprising first, treating said paper to a first plasma treatment such that said layer with voids becomes hydrophilic, and second, treating said paper to a second plasma treatment such that the surface of said layer with voids becomes hydrophobic.

21. The production method of claim 20 wherein said porous layer is an ink receiving layer.

* * * * *